United States Patent [19]

Hyland et al.

[11] 4,089,402

[45] May 16, 1978

[54] SHEET FEEDING MECHANISM FOR AN AUTOMATIC TYPEWRITER

[75] Inventors: Francis P. Hyland, Wauwatosa; Hugo E. Borchert, Greenfield; Harlan J. Pilon, Waukesha, all of Wis.

[73] Assignee: Hy Grip Products Co., West Allis, Wis.

[21] Appl. No.: 701,569

[22] Filed: Jul. 1, 1976

[51] Int. Cl.[2] ..... B41J 11/58

[52] U.S. Cl. ..... 400/625; 400/629

[58] Field of Search ..... 197/127 R, 128, 130, 197/131; 271/3.1, 3

[56] References Cited

U.S. PATENT DOCUMENTS

| | | | |
|---|---|---|---|
| 881,126 | 3/1908 | Hutches | 197/130 |
| 2,366,206 | 1/1945 | Metzner | 197/130 |
| 3,430,748 | 3/1969 | Parri | 197/114 R X |
| 3,625,333 | 12/1971 | Cortona et al. | 197/128 |

FOREIGN PATENT DOCUMENTS

| | | | |
|---|---|---|---|
| 28,191 of | 1909 | United Kingdom | 197/130 |

*Primary Examiner*—Paul T. Sewell

*Attorney, Agent, or Firm*—Andrus, Sceales, Starke & Sawall

[57] ABSTRACT

An improved sheet feeding mechanism for an automatically driven typewriter. The feeder mechanism includes a housing which is mounted on the typewriter and defines a supply magazine for storing a stack of sheets to be typed and a finish magazine for storing typewritten sheets. When it is desired to feed a sheet through the platen of the typewriter, a platen clutch is disengaged to disconnect the platen from the typing mechanism and connect the platen to a feed roll. A pressure plate is actuated to force the pack of sheets in the supply magazine against the feed roll, and the feed roll will scrub the outermost sheet from the pack and move the sheet downwardly through a tapered chute and around the platen. After passing around the platen, the leading edge of the sheet actuates a sensing mechanism to release the pressure plate and engage the platen clutch to thereby begin the automatic typing on the sheet. When the typing is completed, the platen clutch will be disengaged and the sheet is driven upwardly to the finish magazine, and when the trailing edge of the sheet passes the sensing mechanism the pressure plate will be actuated to feed a second sheet to the platen.

16 Claims, 5 Drawing Figures

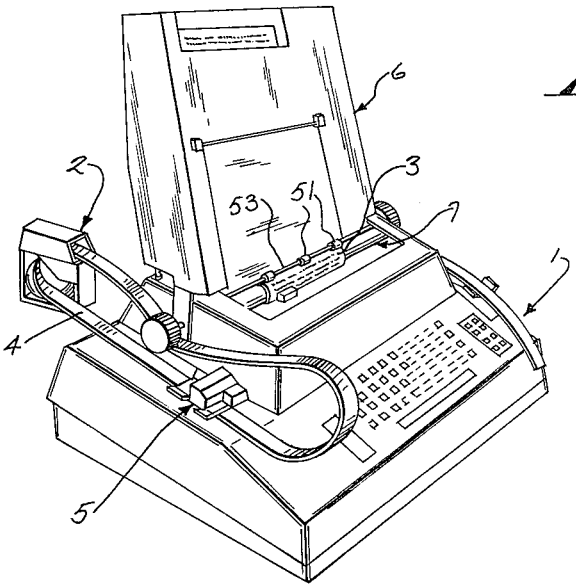
Fig. 1
Fig. 2
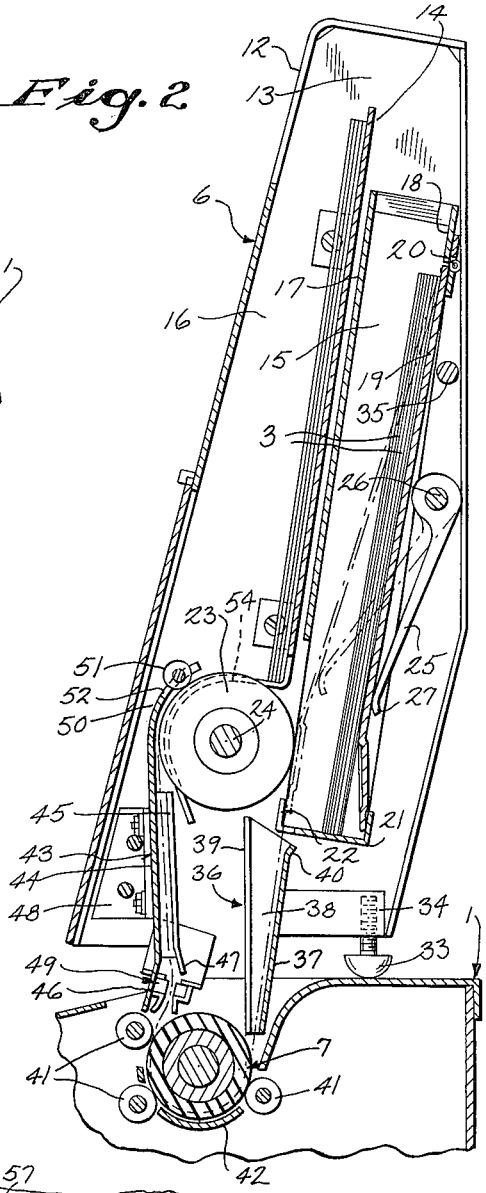
Fig. 3
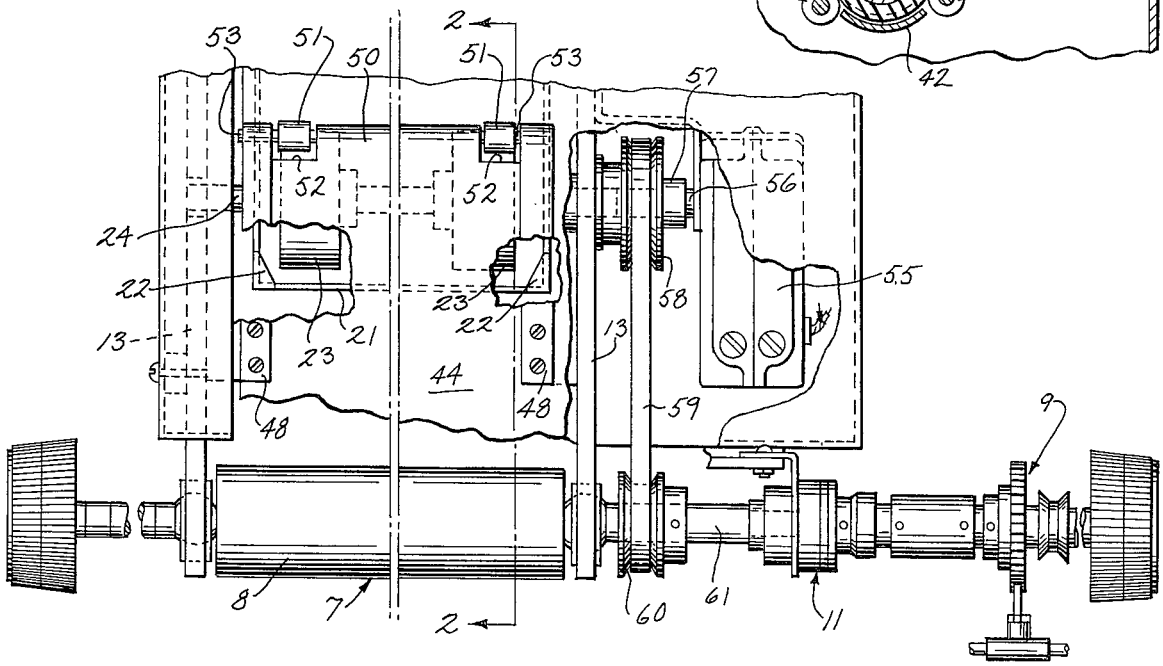

SHEET FEEDING MECHANISM FOR AN AUTOMATIC TYPEWRITER

BACKGROUND OF THE INVENTION

To partially automate the typing process and increase the typing rate, automatic sheet feeding mechanisms have been devised for manually operated typewriters in which the sheets are fed into the typewriter by operation of the platen.

As disclosed in U.S. Pat. No. 3,430,748, the feeding mechanism includes a housing mounted on the typewriter and a pack of sheets to be typed is located within a supply compartment or magazine. Feed rollers are connected to the platen and are driven from the conventional platen drive which is coupled to the motor. When the motor is energized, the feed rolls are operated to automatically feed a new sheet into the typewriter. As the sheet is typed, it is moved upwardly into a storage compartment in the housing.

With the system as disclosed in Pat. No. 3,340,748, the operator activates the feeding mechanism to automatically feed the paper into the typewriter, and after manual operation of the typewriter the sheet is moved to the storage compartment. The system as shown in the aforementioned patent eliminates the need of the operator separately inserting sheets into the typewriter.

The U.S. Pat. No. 3,963,110, describes a sheet feeding mechanism for an automatic typewriter. In accordance with the structure shown in the aforementioned patent application, a pack of sheets to be typed is stored in a magazine or supply compartment in a housing mounted on the typewriter and the feed mechanism includes a pair of cooperating feed rolls which sequentially feed the sheets to the platen of the typewriter. One of the feed rolls is coupled to a motor and the motor, in turn, is connected to the platen of the typewriter. A clutch interconnects the platen with the normal platen drive.

When it is desired to feed a sheet to the platen, the clutch is disengaged and the feed roll motor is energized to thereby feed the outermost sheet in the pack to the platen. The leading edge of the sheet, after passing around the platen, engages a sensing mechanism which acts to re-arrange the clutch to connect the platen to the platen drive to thereby begin the operation of the typing in accordance with the desired programming. When the typing has been completed, a signal is generated to drive the feed roll motor and disengage the clutch to move the sheet to a storage compartment located within the housing.

SUMMARY OF THE INVENTION

The invention relates to an improved sheet feeding mechanism for an automatic typewriter. The sheet feeding mechanism includes a housing that is mounted on the typewriter, and a pack of sheets to be typed is contained within a supply compartment or magazine located in the rear portion of the housing. A pair of generally triangular tabs are located at the lower corners of the supply compartment, and the outermost sheet in the pack faces a rotatable feed roll, while the corners of the outermost sheet engage the tabs. When it is desired to feed a sheet to the platen of the typewriter, the platen clutch is disengaged to disconnect the platen from the platen drive, the drive for the feed roll is simultaneously activated, and the feed roll drive is connected to the platen so that the platen will rotate in synchronization with the feed roll.

Simultaneously with the disengagement of the platen clutch, a pressure plate is operated to force the pack of sheets in the supply magazine against the feed roll, and the roll will scrub the outermost sheet from the pack, snapping the lower corners of the sheet out of engagement with the corner tabs. The sheet will then pass downwardly through a tapered chute and around the platen.

When the leading edge of the sheet passes around the platen, it actuates a sensing mechanism which operates to release the pressure plate and engage the platen clutch with the platen drive and disengage the feed roll drive. The sheet will then be typed in accordance with the programmed sequence.

When the typing is completed, the platen clutch will again be disengaged, the sheet will be moved upwardly around the platen to a storage compartment or magazine in the housing, and when the trailing edge of the sheet passes the sending mechanism, the feed roll drive will be actuated, and the pressure plate will be operated to force the pack of the sheets against the feed roll to feed a second sheet to the platen of the typewriter.

The sheet feeding mechanism of the invention provides improved horizontal and vertical registry from sheet to sheet, meaning that each sentence and letter being typed will appear in exactly the same location on each sheet. The improved registry, is important when using the automatic typewiter to fill in paragraphs or sentences in a form letter.

As the pressure plate is released during the period of typing, drag of the feed rolls against the sheets in the stack in the pack in the storage compartment is minimized. With prior constructions, the pack of sheets was continuously urged against the feed rolls during typing and this provided a continuous drag, so that in some cases full carriage return could not be obtained.

The feed mechanism of the invention, by utilizing a releasable pressure plate, provides an increased capacity for the storage pack. With prior units, in which continuous pressure was utilized to urge the pack of sheets against the feed rolls, it was difficult to maintain uniform pressure with both a thick pack and a thin pack, with the result that the thickness of the supply pack was limited in order to achieve the desired biasing force or pressure.

With the feed mechanisn of the invention, scrubbing of multiple sheets from the pack is eliminated. The feed roll operates against the outermost sheet in the supply pack at a distance of about 1 inch above the bottom of the sheet, and this location of the feed roll in combination with the corner tabs provides a snap action to release the sheet, which eliminates scrubbing of multiple sheets from the pack.

Other object and advantages will appear in the course of the following description.

DESCRIPTION OF THE DRAWINGS

The drawings illustrate the best mode presently contemplated of carrying out the invention.

In the drawings

FIG. 1 is a perspective view of an automatic typewriter incorporating the sheet feeding mechanism of the invention;

FIG. 2 is a vertical section of the sheet feeding mechanism;

FIG. 3 is an enlarged fragmentary front elevation of the mechanism with parts broken away;

DESCRIPTION OF THE ILLUSTRATED EMBODIMENT

Figure 4:
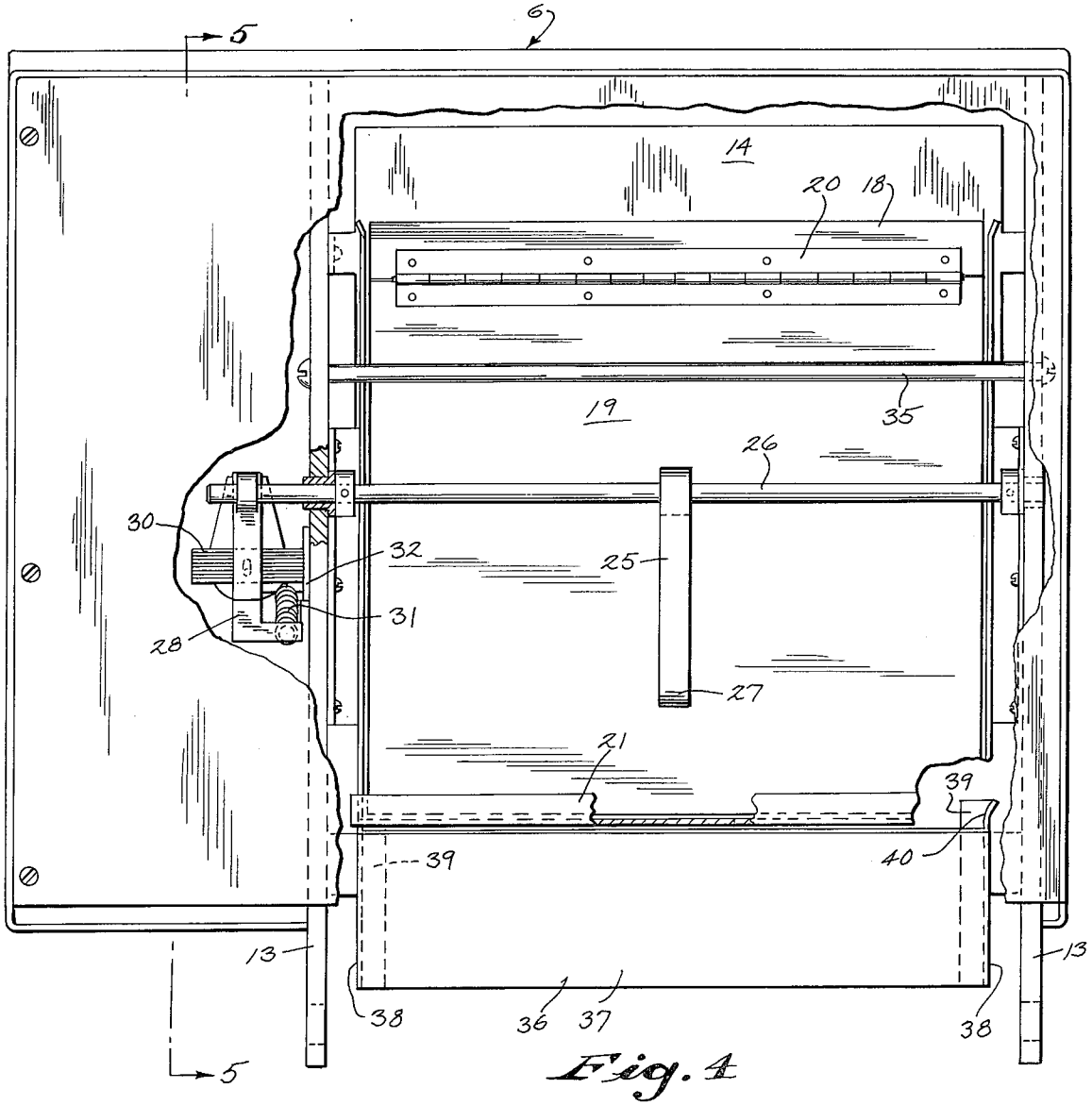
FIG. 4 is a rear elevation of the mechanism with parts broken away.

FIG. 1 illustrates a computerized electrical typewriter 1 adapted to be controlled by a memory tape unit 2 mounted on the side of the typewriter for automatic typing on a paper sheet 3 located in the typewriter. A punched tape 4 of the tape unit 2 forms a record or storage means for material to be reproduced, and the tape is sequentially fed past a reader unit 5 to control the typewriter and provide automatic typing of sequential lines in accordance with conventional systems.

The sheet feeding mechanism 6 of the invention is mounted on the typewriter 1 and acts to sequentially feed sheets to the platen unit 7 of the typewriter.

The platen unit 7 includes a platen 8 which is driven in a conventional manner by a ratchet index drive mechanism indicated generally by 9.

A clutch mechanism 11, similar to that described in the U.S. Pat. No. 3,963,110, is connected in the platen unit 7 and acts, when engaged, to connect the platen 8 to the drive mechanism 9.

The feeding mechanism 6 includes a housing 12 which is mounted on the typewriter 1 and a structural framework is contained within the housing and includes a pair of side plates 13 which are connected together by a center plate 14. Located to the rear of a center plate 14 is a supply compartment or magazine 15 to contain a pack of sheets 3 to be typed, while a storage compartment or magazine 16 is located forward of the center plate 14 and contains the sheets 3 which have been typed.

The supply compartment 15 is defined by a forward plate 17 which extends between the side plates 13 and is located immediately to the rear of plate 14 and a strip 18 is spaced to the rear of the upper portion of plate 17 and also extends between the side plates 13. As best illustrated in FIG. 2, a pressure plate 19 is hinged to the strip 18 by the hinges 20, and the pressure plate is adapted to bear against the rearmost sheet 3 in the supply compartment 15.

The pack of sheets 3 in the supply compartment 15 rests on a channel-shaped bottom plate 21 and the forward flange of the bottom channel 21 is provided with generally triangular tabs 22 which engage the lower corners of the forwardmost sheet 3 in the pack.

During the sheet feeding operation, the pressure plate 19 acts to urge the pack of sheets 3 in the supply compartment against a pair of driven feed rolls 23 which are mounted on shaft 24 that is journalled in the side plates 13.

Figure 5:
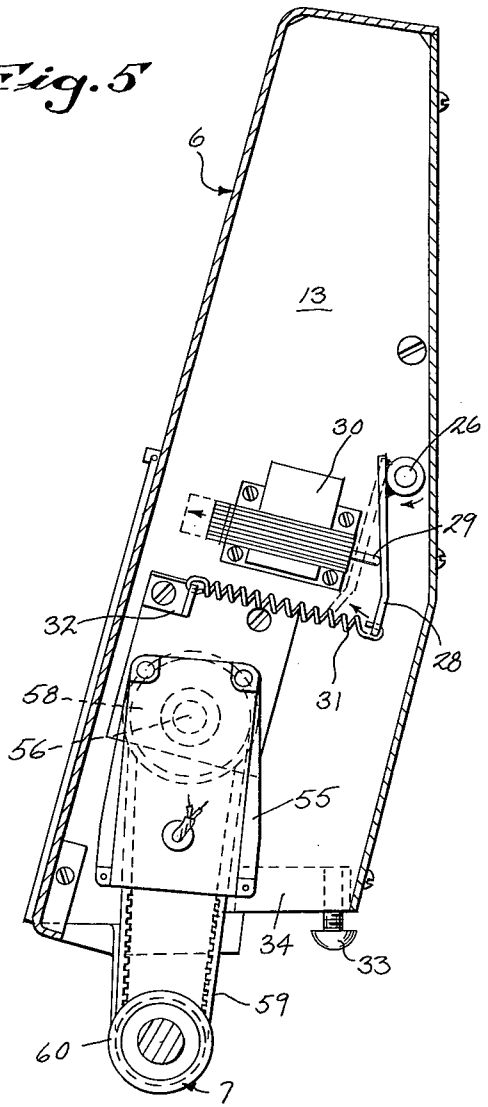
FIG. 5 is a section taken along line 5—5 of FIG. 4.

To urge the pressure plate 19 forwardly against the pack of sheets 3, an arm 25 is mounted on a shaft 26, which is located to the rear of the pressure plate and extends between the side plates 13. As illustrated in FIG. 2, the lower end 27 of the arm is curved and bears against the pressure plate 19. The arm 25 is pivoted through a solenoid operated mechanism, best shown in FIGS. 4 and 5, and including an arm 28 which is connected to the shaft 26, and the arm bears against the plunger 29 of solenoid 30. Energizing the solenoid 30 will move the plunger 29 outwardly to thereby pivot the arm 28 to rotate the shaft 26 counterclockwise as shown in FIG. 5, thereby pivoting arm 25 to the rear and releasing the pressure on the pressure plate 19. When the solenoid 30 is deenergized, a spring 31 which connects a bracket 32 with the end of the arm 28, will move the arm 28 in a clockwise direction as shown in FIG. 5, to thereby pivot the arm 25 against the pressure plate 19 and force the pack of sheets 3 against the surface of the feed rolls 23. It is contemplated that instead of the spring 31 acting to move the pressure plate 19 against the pack of sheets, the structure can be reversed with the solenoid acting to move the pressure plate to the pressure-exerting position and the spring serving to move the pressure plate to the released position.

As shown in FIG. 2, the feeding mechanism is supported on the upper surface of the typewriter 1 by a series of adjustable rubber feet 33, which extend downwardly from the base 34 of the housing.

A stiffening rod 35 extends between the upper portions of the side plates 13 and adds rigidity to the unit.

When the pack of sheets 3 in the supply compartment 15 is urged against the feed rolls 23, the rotating rolls will scrub the outermost sheet from the pack and the lower corners of the sheet will snap out of engagement with the tabs 22 thereby releasing a single sheet from the supply compartment 15 and enabling the sheet to be fed to the platen 7.

The sheet released from the supply compartment 15 is fed to the platen through a guide chute 36 which is composed of a rear plate 37, a pair of side walls 38 and front flanges 39 which are generally parallel to the rear wall 37. The upper edge of the rear wall is flared outwardly as indicated by 40.

The guide chute is tapered in a front-to-rear direction. As shown in FIG. 2, the rear wall 37 and the front flanges 39 taper downwardly and inwardly. This construction insures that the sheet 3 being fed to the platen 8 will be precisely aligned with the platen and insures both horizontal and vertical registry of the typeface on the sheet.

To guide the sheet 3 in movement around the platen 7, a series of guide rolls 41 and a guide shroud 42 are utilized, as illustrated in FIG. 2. The sheet, after passing around the platen, enters a discharge chute 44 which is located forwardly of the guide chute 36. As shown in FIG. 2, the discharge chute 43 includes a front shroud 44 and a pair of rear guide strips 45 which extend outwardly from the side plates 13. The shroud 44 and the guide strip 45 are provided with outwardly flared lower edges 46 and 47, respectively, which receive the sheet from the platen. The front shroud 44 is connected to the side plates 13 through the L-shaped brackets 48.

A sensing unit is associated with the discharge chute, and as illustrated in the drawings, may take the form of a photo-sensitive switch mechanism 49. However, it is contemplated that other types of sensing mechanisms, such as a mechanical switch actuated by the paper, may be employed in place of the photo-sensitive switch. When the leading edge of the sheet 3 engages the sensing unit 49, as the sheet is moved around the platen, the sensing unit will operate to engage the clutch unit 11 to connect the platen with the index drive 9 and simultaneously operate the solenoid 30 to release the force of the pressure plate against the pack of sheets 3 in the supply compartment 15, as will be more fully described hereinafter. When the trailing edge of the sheet passes the sensing unit the sensing unit will deenergize the solenoid 30 to enable spring 31 to operate the pressure plate 19 and force the pack of sheets 3 against the feed rolls 23 to feed a second sheet to the platen.

The upper edge portion 50 of the shroud 44 is curved rearwardly and a pair of idler rolls 51 are located within recesses 52 formed in the upper portion 50 of the shroud. Idler rolls 51 are mounted on shafts 53 which are mounted on straps attached to shroud 44, and the sheet 3 being fed upwardly from the platen 8 passes between the idler rolls 51 and the cooperating feed roll 23.

The typed sheets are stored in the storage compartment or magazine 16 and the lower edges of the typed sheets rest on the ledge or flange 54 extending forward from the center plate 14.

The feed rolls 23 are driven by a motor 55 and the motor shaft 56 of motor 55 is connected through a one-way clutch 57 to the feed roll shaft 24. See FIG. 3. Sprocket 58 is connected to the shaft 56 and a timing belt 59 connects the sprocket 58 with a sprocket 60 on the platen shaft 61. With this construction, the feed rolls 23 are connected to the platen 8 so that operation of the feed drive motor 55 will act to rotate the platen 8 when the clutch unit 11 is disengaged. During the automatic typing sequence, the stepping of the platen 8 will be transmitted through the belt 59 to the feed rolls 23, but due to the one-way clutch 57 the stepping motion of the platen will not be transmitted back to the motor 55.

OPERATION

A pack of sheets 3 to be typed is inserted into the supply compartment 15 by releasing the back plate 19 and dropping the pack into the compartment. The pack of sheets will rest on the channel-shaped bottom member 21 and the forward sheet will be retained by the corner tabs 22.

To feed the sheet feeding operation, the controls are actuated which will disengage the clutch unit 11, thereby disconnecting the platen 8 from the platen drive. Simultaneously, the motor 55 will be operated which acts to drive the feed rolls 23, as well as the platen through the belt drive 59.

At this time, the solenoid 30 is de-energized so that the force of the spring 31 acting through the pressure plate 19 will urge the pack of sheets 3 against the rotating feed rolls 23, thereby causing the outermost sheet in the pack to be scrubbed from the pack and fed to the guide chute 36.

The construction of the guide chute 36 acts to properly align the sheet 3 as it is moved to the platen 7 to thereby insure both horizontal and vertical registry of the type face.

The sheet 3 passes around the platen 8 and when the leading edge of the sheet engages the sensing unit 49, the operation of the motor 55 will be stopped and the clutch unit 11 will be re-engaged to connect the platen 8 to the platen drive mechanism 9. Simultaneously, the solenoid 30 will be engaged to pivot the pressure plate 19 rearwardly and remove the biasing force on the pack of sheets in the supply compartment 15. The pack of sheets in the supply compartment 15 will not necessarily move to the rear as the pressure is released, but there will be no force urging the sheets against the feed rolls 23 during the typing operation, so that the feed rolls 23 can rotate or step with the platen without drag caused by engagement of the feed rolls with the sheets.

When the typing has been completed, the clutch unit 11 is disengaged and the motor 55 is operated to drive the feed rolls 23 and draw the sheets upwardly through the discharge chute 43 to the storage compartment 16. At this time, the solenoid 30 is still energized so that the pack of sheets in the supply compartment is not biased against the feed rolls 23. As the trailing edge of the typed sheet moves out of contact with the sensing unit 49, the solenoid 30 will be de-energized thereby permitting the spring 31 to urge the sheets in the supply pack against the feed rolls 23 to feed a second sheet to the platen 8.

The feed mechanism of the invention provides improved registry of the type face both vertically and horizontally from sheet to sheet. This insures that the typed material will be located in precisely the same position on each sheet and this is particularly important where the program is utilized to type or fill in sentences or paragraphs in a form letter.

As the pressure of the pressure plate 19 is released during the automatic typing sequence, drag caused by rotation of the feed roll against the sheets in the supply compartment is minimized, thereby insuring full carriage return.

As the pressure is released on the supply stack during the time of typing, a stronger biasing force can be utilized during the feeding sequence, and therefore the unit has greater capacity in that a thicker pack of sheets can be utilized in the storage compartment.

As the feed rolls operate a substantial distance above the bottom edge of the sheet in the storage magazine 15 and as the bottom corners of the sheets are retained by the tabs 22, the outermost sheet is scrubbed from the pack with a snap-like action which eliminates the possibility of scrubbing multiple sheets from the pack.

Various modes of carrying out the invention are contemplated as being within the scope of the following claims particularly pointing out and distinctly claiming the subject matter which is regarded as the invention.

We claim:

1. A sheet feeding mechanism for an automatic typewriter having a platen, comprising a housing defining a supply compartment for storing a supply pack of sheets to be typed and defining a storage compartment for storing a series of typed sheets, a feed roll mounted for rotation with respect to the housing and disposed to rotate in contact with an outermost sheet in the supply compartment to remove the outermost sheet from the supply pack, first guide means for guiding the sheet removed from the supply pack to the platen of the typewriter in preparation for typing said sheet, second guide means for guiding the typed sheet from the platen to the storage compartment, releasable pressure means having an operable pressure exerting position wherein the feed roll and the supply pack are forced into intimate contact and having an inoperative position, operating means for moving the pressure means to the operative position, to thereby enable the feed roll to remove the outermost sheet from the supply pack and sensing means disposed adjacent said second guide means for sensing the leading edge of the sheet as it passes around the platen for actuating said operating means and moving said pressure means to the inoperative position, whereby the force between said pressure means and said feed roll is released during typing of the sheet.

2. The sheet feeding mechanism of claim 1, wherein said first guide means comprises a chute having a pair of side walls, a front wall and a rear wall, said front and rear walls sloping downwardly and inwardly toward each other.

3. The sheet feeding mechanism of claim 1, wherein said sensing means is operable to sense the trailing edge of the sheet as it is moved from the platen to the storage compartment and actuate said operating means to move the pressure means to the operative pressure exerting position.

4. The sheet feeding mechanism of claim 1, wherein said supply compartment includes a bottom surface to support the pack of sheets and a forward surface having an opening, said feed roll extending through said opening and disposed to engage the outermost sheet in said pack.

5. The sheet feeding mechanism of claim 4, wherein said forward surface is provided with corner tabs located adjacent the side edges of the bottom surface and positioned to engage the lower corners of the outermost sheet in said supply pack, said feed roll acting to snap the outermost sheet out of engagement with said corner tabs.

6. The sheet feeding mechanism of claim 1, wherein said pressure means comprises a plate, and pivoting means for pivoting the plate between the operative and inoperative positions.

7. The sheet feeding mechanism of claim 6, wherein said pivoting means comprises an arm engaged with said pressure plate, and means for pivoting the arm to thereby pivot the pressure plate between the operative and inoperative positions.

8. A sheet feeding mechanism for an automatic typewriter having a platen, comprising a housing mounted on the typewriter and defining a supply compartment for storing a supply pack of sheets to be typed and a storage compartment for storing a series of typed sheets, a feed roll mounted for rotation with respect to the housing and disposed to rotate against the outermost sheet in the supply pack to thereby scrub the sheet from the pack, drive means operably connected to the feed roll to rotate the same, first guide means for guiding the sheet scrubbed from the supply pack to the platen in preparation for typing said sheet, second guide means for guiding the typed sheet from the platen to the storage compartment, pressure means for applying pressure to the supply pack to force the supply pack against the feed roll, said pressure means being movable between an operative position and an inoperative position, means responsive to a sheet being fed from the supply pack to a pre-determined position with respect to the platen for moving the pressure means to the inoperative position, and means responsive to the sheet being moved to a second pre-determined position on completion of typing for operating the pressure means and moving the pressure means to the operative position.

9. The sheet feeding mechanism of claim 8, wherein said drive means includes a motor having a drive shaft operably connected to said feed roll, and connecting means for connecting said drive shaft to the platen whereby rotation of said drive shaft will be transmitted to said platen to rotate the same.

10. The sheet feeding mechanism of claim 8, and including an idler roll located adjacent the outlet of said second guide means and disposed in cooperating relation with the feed roll, whereby the typed sheet is moved between said feed roll and said idler roll to the storage compartment.

11. The sheet feeding mechanism of claim 9, wherein said first guide means comprises a chute having a pair of side walls, a front wall and a rear wall, and said front and rear walls, sloping downwardly and inwardly toward each other.

12. A sheet feeding mechanism for an automatic typewriter having a platen, comprising a housing defining a supply compartment for storing a plurality of sheets to be typed, feed means mounted for movement with respect to the housing and disposed to move in contact with an outermost sheet in the supply compartment to move the outermost sheet from the compartment, first guide means for guiding the sheet removed from the supply compartment to the platen of the typewriter in preparation for typing said sheet, second guide means for guiding the typed sheet from the platen, pressure means adapted to be disposed in a pressure exerting relation with said feed means wherein the feed means and the outermost sheet in the storage compartment are forced into intimate contact to thereby enable the feed means to remove said outermost sheet from the supply compartment, and means responsive to a sheet being fed from the supply compartment to a predetermined position with respect to the platen for releasing the pressure exerting relation between the feed means and the pressure means during typing of the sheet in the platen.

13. The mechanism of claim 12, and including means responsive to a sheet being moved to a second predetermined position on completion of typing for effecting a pressure exerting relation between the feed means and said pressure means to enable the feed means to remove the next sheet from the supply compartment.

14. The mechanism of claim 12, wherein the supply compartment includes a bottom surface to support the plurality of sheets, said bottom surface having a forward edge facing said feed means and a pair of side edges, said forward edge having upwardly extending tabs located adjacent said side edges and positioned to engage the lower corners of the outermost sheet in said supply compartment, said feed means acting to snap the outermost sheet out of engagement with said tabs on movement of said feed means.

15. The mechanism of claim 14, wherein said tabs have a generally triangular shape.

16. The mechanism of claim 12, wherein said first guide means comprises a chute having a pair of side walls, a front wall and a rear wall, said front and rear walls sloping downwardly and inwardly toward each other.

* * * * *

UNITED STATES PATENT AND TRADEMARK OFFICE

CERTIFICATE OF CORRECTION

PATENT NO. : 4,089,402

DATED : May 16, 1978

INVENTOR(S) : FRANCIS P. HYLAND ET AL

It is certified that error appears in the above-identified patent and that said Letters Patent are hereby corrected as shown below:

Column 1, Line 44, Cancel "re-arrange" and substitute therefor ---re-engage---, Column 2, Line 55, Cancel "object" and substitute therefor ---objects---, Column 5, Line 34, Cancel "feed" and substitute therefor ---start---

Signed and Sealed this

*Twelfth* Day of *December 1978*

[SEAL]

*Attest:*

RUTH C. MASON
*Attesting Officer*

DONALD W. BANNER
*Commissioner of Patents and Trademarks*